US006128865A

United States Patent [19]

Din

[11] Patent Number: 6,128,865

[45] Date of Patent: Oct. 10, 2000

[54] LIQUID DISPERSING SCREEN

[76] Inventor: Michael W. Din, 54 Edgewood Dr., Florham Park, N.J. 07932

[21] Appl. No.: 09/259,924

[22] Filed: Mar. 1, 1999

[51] Int. Cl.[7] ..... E04B 7/18

[52] U.S. Cl. ..... 52/94; 52/97; 52/11; 52/12; 52/90.1; 52/90.2

[58] Field of Search ..... 52/94, 97, 11, 52/12, 90.1, 90.2

[56] References Cited

U.S. PATENT DOCUMENTS

| | | | |
|---|---|---|---|
| 282,641 | 8/1883 | Jackson | 52/12 |
| 1,564,032 | 12/1925 | Stuckert | 52/90.1 |
| 2,229,381 | 1/1941 | Grow | 52/94 |
| 3,939,616 | 2/1976 | Schapker | 52/94 |
| 4,068,424 | 1/1978 | Madfis | 52/94 |
| 4,730,423 | 3/1988 | Hughes | 52/173 R |
| 4,745,710 | 5/1988 | Davis | 52/12 |
| 5,261,196 | 11/1993 | Buckenmaier et al. | 52/94 |
| 5,321,920 | 6/1994 | Sichel | 52/12 |
| 5,555,680 | 9/1996 | Sweers | 52/12 |
| 5,560,158 | 10/1996 | Norton | 52/95 |

*Primary Examiner*—Carl D. Friedman
*Assistant Examiner*—Phi Dieu Tran A
*Attorney, Agent, or Firm*—Edward Goldberg

[57] ABSTRACT

A fine mesh screen structure is mounted along a wall in the path of a flow of liquid to divide and split larger size liquid drops into much smaller droplets which are dispersed without agglomeration. In a preferred embodiment a series of support angle brackets are spaced along the length of a sloped roof end around the perimeter of the building. Support bars extend outwardly from the brackets to hold the mesh screen in the path of rainwater falling from the roof. The support bars may hold the mesh at an acute downward angle several inches below the roof to provide sufficient momentum for the drops to be forced through the mesh for size reduction. In another embodiment, the screen may position along an internal wall within a cooling tower in the path of water distributions to similarly reduce the size of water droplets which can be more effective for the cooling function.

15 Claims, 2 Drawing Sheets

LIQUID DISPERSING SCREEN

BACKGROUND OF THE INVENTION

1. Field of the Invention

The present invention relates to devices for dispersing liquids such as rainwater run-off from roofs of houses or buildings, or water droplets as used in cooling towers. A unique mesh screen structure reduces the size of liquid droplets to prevent the impact and accumulation effects of larger liquid droplets, as used in rainwater service, and improves the cooling function, as used in cooling tower service. Use of the screen eliminates the usual gutter and leader structures required to remove rainwater flow or can replace cooling tower internal fill materials, e.g. wood baffle fill, splash type PVC fill or film type fill.

2. Description of the Prior Art

U.S. Pat. No. 3,939,616 to Schapker concerns a rain water run-off disperser structure comprising deflector plates extending laterally at a small downward angle from a side wall of the building below the roof edge in the path of falling water. The deflector plates include a plurality of small apertures with associated deflecting surfaces at larger downward angles which direct the rain water outwardly and downwardly from the roof. Larger streams of rainwater are dispersed into separate sprays to avoid direct run off without the use of gutters.

U.S. Pat. No. 4,010,577 to Stalter is directed to a roof drain system employing a housing extending along the lower edge of a roof and having a multiplicity of small openings through which water can be dispersed. The housing forms an elongated air duct with high pressure air supplied by a motor driven blower to cause jets of air that force droplets of water through the openings to disperse the water over a large area. The usual water troughs and downspouts are eliminated.

U.S. Pat. No. 4,068,424 to Madfis utilizes angled deflector plates extending along and below the edge of the roof. The plates include a plurality of vertical baffles having spaced protrusions which impede and uniformly distribute the heavy flows of rainwater to disperse the rain in a random pattern of small droplets. The use of gutters is avoided.

U.S. Pat. No. 4,646,488 to Burns discloses a rain disperser system utilizing a plurality of parallel angled deflector plates supported on a base plate extending around the perimeter of the roof. Spacer elements hold the deflector plates in a desired position.

U.S. Pat. Nos. 5,261,195, 5,261,196, and 5,579,611 to Buckenmaier et al disclose several variations of roof water dispersal systems utilizing deflector plates of different configurations running along a support structure around and below the perimeter of the roof. Desired angular orientations of louvers and slats are maintained by cross-member spacers.

While various forms of prior art water droplet dispersing devices have been shown, these employ relatively complex structures of solid deflector plates with openings which are inefficient and do not produce water droplets of uniformly reduced size which can be dispersed into much finer sprays or mist.

SUMMARY OF THE INVENTION

It is therefore the primary object of the present invention to provide a structure which reduces the size of large drops of liquid such as water into much smaller droplets which can be readily dispersed.

It is another object of the invention to employ a unique structure which splits larger drops to form very small droplets which are prevented from agglomerating.

An additional object of the invention is to provide a mesh screen structure having very fine openings which cause drops of water to be divided into much reduced sizes to minimize accumulation of residual liquid.

It is also an object of the invention to provide a mesh screen structure having openings of smaller size than the impinging liquid drops and of a thickness of material which further reduces the drop size.

A further object of the invention is to eliminate the use of gutters and leaders, minimize accumulations of leaves and debris, simplify cleaning of the open mesh structure, avoid rotting of fascia board below the roof and reduce collection of ground water.

A further object of the invention is to provide a means of tightening the mesh screen by using an octagonal hole for the square assembly of support rods to permit 45 rotations.

A still further object is to provide more efficient dispersion of water droplets in other structures such as a cooling tower to improve the cooling function.

These objects and advantages are achieved with a novel mesh screen structure which, as used in a rainwater dispersing system, is mounted along the fascia below the roof.

A series of support angle brackets are spaced along the length of the sloped ends of the roof with support bars extending outwardly to hold the mesh screen in the path of rainwater falling from the roof. The mesh is preferably secured to the bars which are angled downwardly at a small acute angle below the roof overhang. The mesh screen is formed of fine small openings and of a thickness which splits and divides larger rain drops into much smaller droplets which can readily be dispersed with a minimum of agglomeration. The mesh is spaced at a given distance below the roof edge so that the drops fall on the mesh with sufficient momentum to force the drops through the smaller openings to reduce the droplet size. The screen may also be used in other structures such as cooling towers to obtain a reduction in size of water droplets. Other objects and advantages will become apparent from the following description in conjunction with the accompanying drawings.

DESCRIPTION OF THE PREFERRED EMBODIMENT

Figure 1:
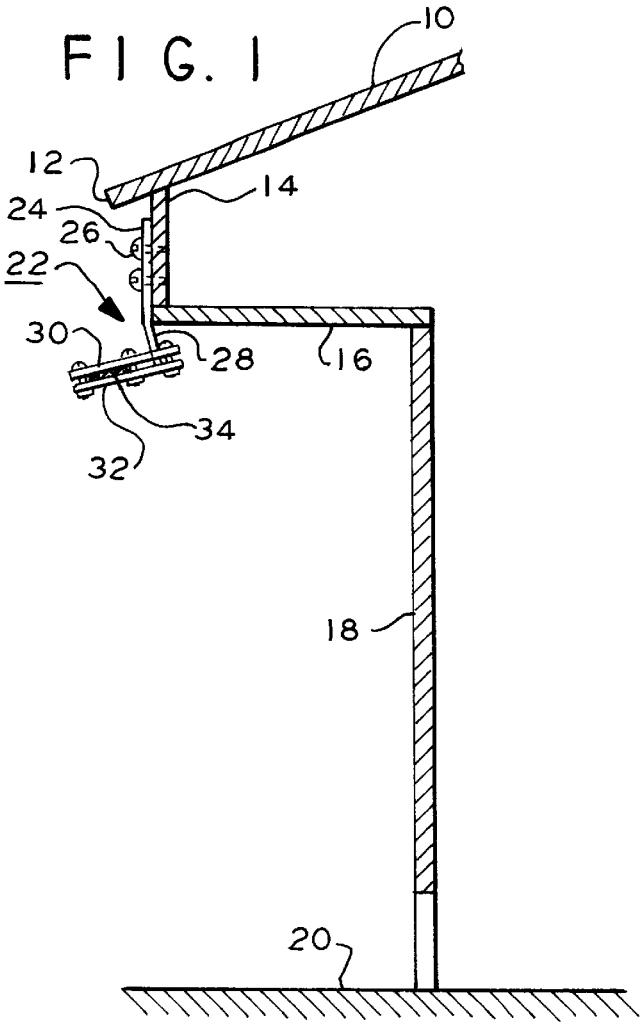
FIG. 1 is a side sectional view of a portion of a house showing the roof, fascia, and screen and support structure mounted on the fascia below the roof.

As shown in FIG. 1, a side sectional portion of a typical house includes a slanted roof 10 having an edge 12 extending over a vertical fascia board 14 below the roof edge. A horizontal overhang 16 is set back from the fascia to join the side of the house 18 which is supported on a foundation built into a ground surface 20. A typical support angle bracket 22 includes a vertical plate 24 secured to the fascia board by screws 26. A lower angled plate portion 28 extends below the fascia and engages a pair of screen holding bars 30, 32.

Figure 2:
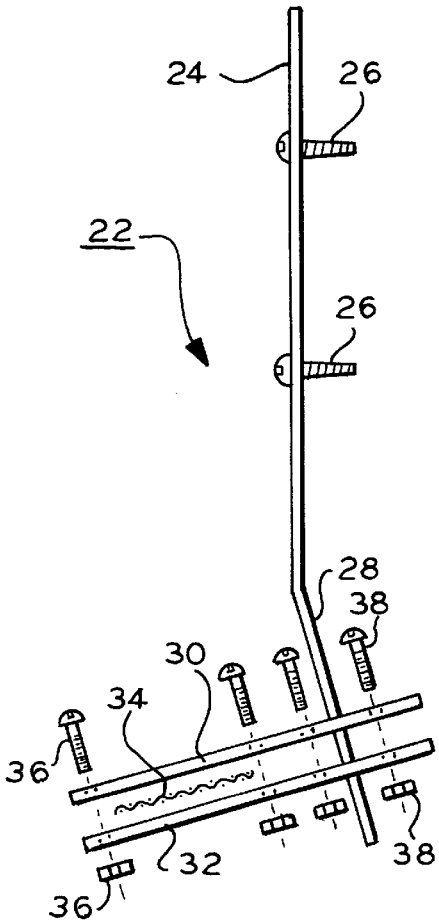
FIG. 2 is a side sectional view of the support angle bracket and holding bars supporting the screen.
Figure 3:
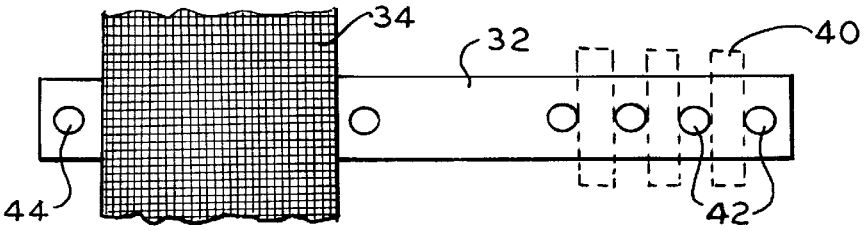
FIG. 3 is a top view of a holding bar and portion of a screen.
Figure 4:
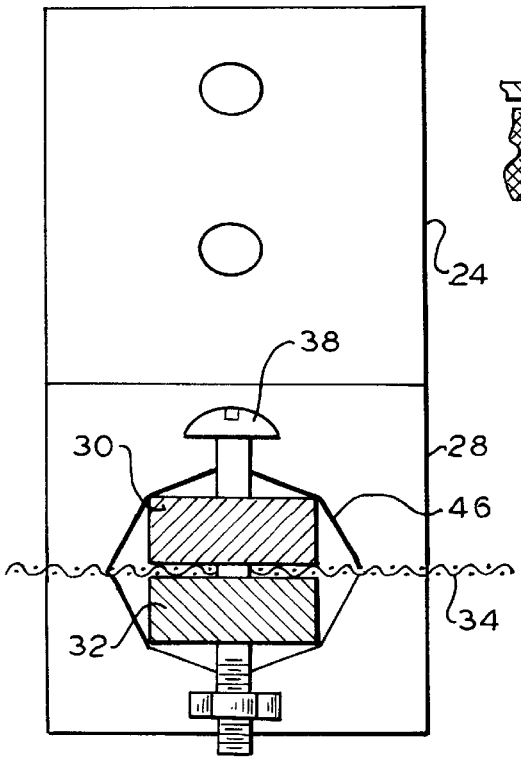
FIG. 4 is a front view of the support angle bracket, holding bars and screen.

The structural details of the support angle bracket, screen holding bars and screen are shown more clearly in the side sectional view of FIG. 2, the top view of FIG. 3 and the front view of FIG. 4. The lower angled bracket portion may be approximately at a 15 to 20 degree angle from vertical and the screen and holding bars are also preferably at 15 to 20 degrees from the horizontal. The mesh may also be held at a horizontal angle between horizontal bars as well. The fine mesh screen 34 is preferably mounted between pairs of holding bars 30,32 above and below the screen with holding nuts and bolts 36 securing the screen in place. Screen positioning nuts and bolts 38 determine the position of the screen width extending outwardly from the fascia along the holding bars which may be adjustable.

As shown in FIG. 3, the support angle bracket may engage the holding bars at different positions, as indicated by dotted lines 40, and the screen positioning bolts may be coupled through different positioning holes 42. The screen holding bolts pass through corresponding holes 44 in the holding bars. A preferred structure for securing the holding bars and screen to the support angle bracket is shown in FIG. 4. The lower angled bracket portion 28 includes an octagonal hole 46 through which upper and lower holding bars 30, 32 extend in a snug fit. The bars are secured in position by bolts 38 with the screen held between the bars. The octagonal opening permits the bars and screen to be rotated 45 degrees to engage another portion of the octagonal hole and assist in tightening the screen as it is mounted in the bracket and holding bar assembly along the roof perimeter.

Figure 5:
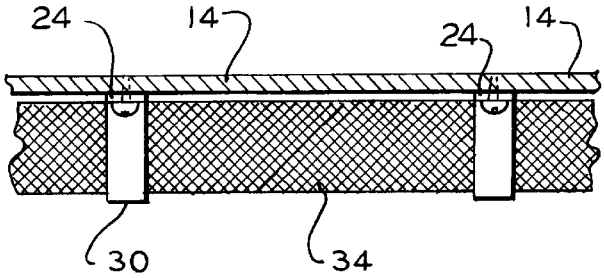
FIG. 5 is a top view of a screen portion mounted on support brackets.
Figure 6:
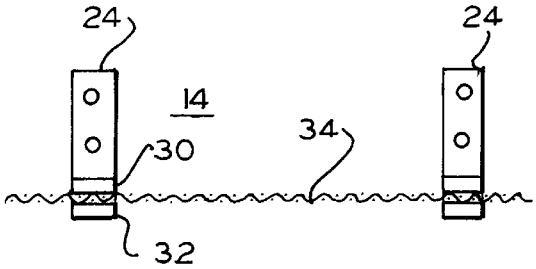
FIG. 6 is a front view of a screen portion mounted on support brackets.

As shown in FIGS. 5 and 6, the screen 34 extends several inches outwardly from the fascia board 14 along the length of the house below the roof. The support bracket plates 24, 28 and holding bars 30, 32 are mounted at spaced intervals along the fascia to support the screen along its length. A single lower holding bar may be secured to the angled bracket to hold the mesh screen in position without requiring a pair of upper and lower bars. Multiple mesh layers may also be used for increased effects. Such multiple layers do not require the meshes to be in parallel or alignment to function properly.

Figure 7:
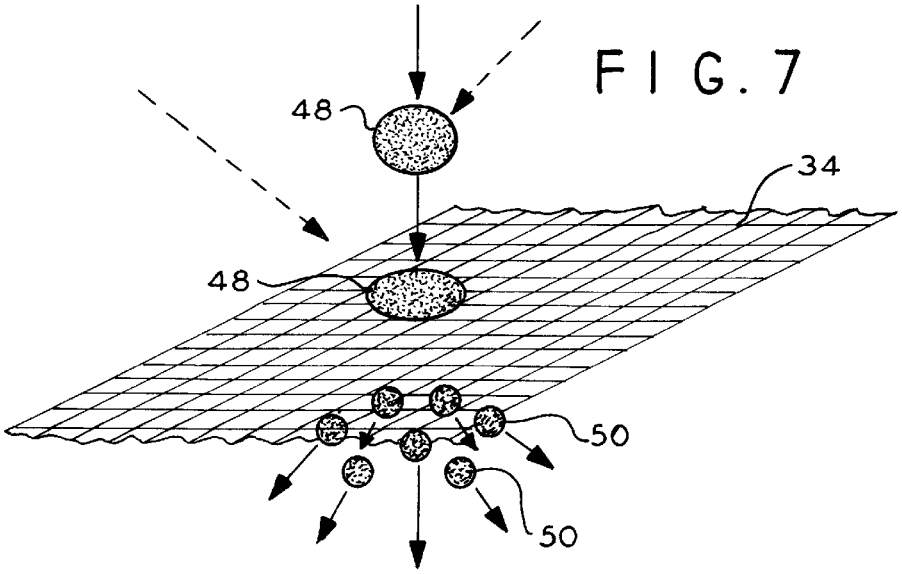
FIG. 7 is a schematic representation of a mesh screen operating to divide and disperse rain drops.

The operation of the screen in dividing and reducing the size of liquid drops is illustrated in FIG. 7. The larger drops 48 strike the smaller openings of the fine mesh screen 34 which may be typically 15 to 16 mesh openings per inch. The force of the drops falling several inches from the roof and the small size of the mesh openings cause the drops to divide and split into much smaller droplets 50. The mesh screen thickness also may be changed to further reduce the size of the openings. Typical wire mesh screens may be in the order of one hundredth of an inch in thickness. The wire mesh may be of a suitable fine metal or plastic screen.

A 6–9 inch vertical drop distance from the roof is required for a mesh equivalent to that used for a common window screen in order to minimize re-agglomeration of liquid past the mesh. The mesh thickness causes droplets to increase the diameter of impact from the original drop and forces the drop through more openings to further reduce drop size. Liquid surface tension also causes spanning of the mesh opening with residual liquid to hold a set amount of liquid in place to prevent accumulation of additional residual liquid into larger drops. Use of an angled mesh causes residual liquid to gravitate away from the original impact area which avoids re-agglomeration of droplets impacting at the same location. The downward angle also makes it more difficult for leaves and other debris from collecting on the screen.

The present invention thus eliminates the need for gutters and down spouts, avoids rotting of the fascia board behind the gutters, reduces retention of leaves and other debris on the top open mesh surface, permits easy cleaning of the mesh from grade level with a water hose, minimizes re-agglomeration of liquid due to filming or holdup on the mesh openings, disperses the droplets over a wide area to eliminate collection of ground water close to the foundation, and minimizes the ground trenching effect of large drops to further eliminate collection of ground water close to the foundation.

The liquid dispersing screen may also be used with other structures such as cooling towers where the mesh screen is mounted in the path of water distribution therein to divide larger drops into smaller droplets for dispersal and better cooling function. The screen may be mounted to opposite end walls within the interior of a rectangular tower and be positioned adjacent to and along a vertical wall between the two end walls. The screen may be at a horizontal angle or at a small downward angle while in the path of the distributed water. A plurality of layers of screens each positioned several inches below the upper layers may be used and may also be spaced outwardly from the adjacent wall. Such screens may be used to replace interior baffles or fill that are generally employed and thereby provide more efficient dispersion of water droplets and facilitate the cooling function.

While only a limited number of embodiments have been illustrated and described, other variations may be made in the particular configuration without departing from the scope of the invention as set forth in the appended claims.

What is claimed is:

1. A rainwater dispersing system on a building having a sloping roof, comprising:

a plurality of brackets mounted along a vertical wall board disposed inwardly and below a roof, said brackets being spaced at intervals along the perimeter of said roof, each said bracket including a vertical portion secured on said wall board and an outwardly extending portion extending beyond the edge of said roof, and a fine mesh screen secured to said outwardly extending bracket portions to extend beyond said roof edge in the path of rainwater falling from said roof, said screen being secured to said plurality of brackets to extend along the perimeter of said roof.

2. The rainwater dispersing system of claim 1 wherein each said bracket includes an upper vertical portion secured to said vertical wall board and a lower inwardly angled portion disposed below said vertical wall board at a setback wall portion.

3. The rainwater dispersing system of claim 2 wherein said outwardly extending bracket portion includes upper and lower support bars secured to said lower angled bracket portion, said screen being secured between said bars.

4. The rainwater dispersing system of claim 3 wherein said support bars are angled downwardly at an acute angle from a horizontal plane.

5. The rainwater dispersing system of claim 4 including a first plurality of nuts and bolts securing said upper and lower support bars to said screen.

6. The rainwater dispersing system of claim 5 including a plurality of holes in said bars receiving said first bolts securing said screen.

7. The rainwater dispersing system of claim 6 including a second plurality of nuts and bolts positioning each said lower bracket portion at selective locations along said bars, said bars having a plurality of holes receiving said second bolts positioning said lower bracket portion and screen.

8. The rainwater dispersing system of claim 7 wherein each lower angled bracket portion includes an octagonal opening, said upper and lower support bars having respective inner ends extending through said opening, said second plurality of nuts and nuts positioning and securing said upper and lower support bar inner ends at selective positions within said opening.

9. The rainwater dispersing system of claim 1 wherein said mesh screen includes very fine openings of a generally smaller size than the size of drops of rainwater directed thereon from the sloping roof above said screen, said screen causing said drops to divide and be reduced in size into smaller droplets for dispersion without accumulation into larger drops and water streams.

10. The rainwater dispersing system of claim 9 wherein the number of openings per unit length and the thickness of the screen mesh material determine the reduction in size of larger rain drops into smaller droplets.

11. The rainwater dispersing system of claim 10 wherein the mesh screen has between 15 to 16 openings per inch with a thickness of about 0.01 inches.

12. The rainwater dispersing system of claim 10 wherein said mesh screen is positioned below the edge of said roof within a given proximity for the force of the falling rainwater impinging on said screen to result in further division into smaller droplets.

13. The rainwater dispersing system of claim 12 wherein said mesh screen is positioned 6 to 9 inches below said roof edge.

14. The rainwater dispersing system of claim 4 wherein said mesh screen is positioned at an acute angle of from 15 to 20 degrees from the horizontal, said angle aiding in dispersion of rainwater without accumulation at the impact area.

15. The rainwater dispersing system of claim 8 wherein the combination of the octagonal hole and the square assembly of the upper and lower support bars permit the tightening of the mesh screen by rotation of the support bar assembly with attached screen, the number of sides in the hole is a multiple of the number of sides of the support bar assembly.

* * * * *